US006568008B2

(12) United States Patent
Siepmann et al.

(10) Patent No.: US 6,568,008 B2
(45) Date of Patent: May 27, 2003

(54) MEDICAL EXAMINATION TABLE WITH TWO-WAY DRAWERS AND ARTICULATING BACKREST

(75) Inventors: Paul J. Siepmann, Hartland, WI (US); Michael J. Marchant, Franklin, WI (US); Edward A. Raleigh, Waunakee, WI (US)

(73) Assignee: The Brewer Company, LLC, Menomonee Falls, WI (US)

( * ) Notice: Subject to any disclaimer, the term of this patent is extended or adjusted under 35 U.S.C. 154(b) by 0 days.

(21) Appl. No.: 09/884,882

(22) Filed: Jun. 19, 2001

(65) Prior Publication Data

US 2002/0189014 A1 Dec. 19, 2002

(51) Int. Cl.[7] ..... A47C 20/04
(52) U.S. Cl. ..... 5/617; 5/621; 5/634
(58) Field of Search ..... 5/622, 621, 635, 5/637, 633, 617; 312/289, 287

(56) References Cited

U.S. PATENT DOCUMENTS

| | | | | | |
|---|---|---|---|---|---|
| 2,565,784 | A | * | 8/1951 | Sheean | 312/286 |
| 2,606,801 | A | | 8/1952 | Shampaine | |
| 2,659,902 | A | | 11/1953 | Fitzgerald | |
| 2,682,671 | A | | 7/1954 | Faure | |
| 2,788,529 | A | * | 4/1957 | Moritzacky et al. | 5/634 |
| 2,941,215 | A | | 6/1960 | Johnson | |
| 3,016,275 | A | * | 1/1962 | Grant | 312/287 |
| 3,281,141 | A | | 10/1966 | Smiley et al. | |
| 3,334,951 | A | * | 8/1967 | Douglass, Jr. et al. | 312/286 |
| 4,183,596 | A | * | 1/1980 | Greene et al. | 312/286 |
| 4,501,414 | A | | 2/1985 | Mason et al. | |
| 4,540,165 | A | | 9/1985 | Green et al. | |
| 4,545,628 | A | | 10/1985 | Richey | |
| 4,557,471 | A | | 12/1985 | Pazzini | |
| 4,558,857 | A | | 12/1985 | Heller | |
| 4,586,762 | A | | 5/1986 | Kennedy et al. | |
| 4,589,642 | A | | 5/1986 | Schnelle et al. | |
| D286,481 | S | | 11/1986 | Case et al. | |
| 4,667,354 | A | * | 5/1987 | Carey et al. | 5/614 |
| 4,858,260 | A | | 8/1989 | Failor et al. | |
| 4,865,303 | A | | 9/1989 | Hall | |
| 4,872,657 | A | | 10/1989 | Lussi | |
| 4,937,902 | A | | 7/1990 | Ceike Shapiro | |
| 4,996,731 | A | * | 3/1991 | Kruyt | 5/618 |
| 5,005,667 | A | | 4/1991 | Anderson | |
| D341,737 | S | | 11/1993 | Shepherd | |
| D345,266 | S | | 3/1994 | Koguma | |
| D370,572 | S | | 6/1996 | Lin | |
| 5,528,782 | A | | 6/1996 | Pfeuller et al. | |
| 5,645,313 | A | | 7/1997 | Best et al. | |
| 5,660,405 | A | | 8/1997 | Campbell | |
| D386,634 | S | | 11/1997 | Daugs | |
| 5,706,678 | A | | 1/1998 | Saski | |
| 5,860,899 | A | * | 1/1999 | Rassman | 5/609 |
| 5,926,876 | A | * | 7/1999 | Haigh et al. | 5/634 |
| 6,073,284 | A | | 6/2000 | Borders | |
| 6,106,065 | A | | 8/2000 | Carroll | |
| 6,173,461 | B1 | | 1/2001 | Alexander | |
| 6,202,230 | B1 | | 3/2001 | Borders | |
| 6,212,713 | B1 | | 4/2001 | Kuck et al. | |
| 6,276,012 | B2 | | 8/2001 | Borders | |
| 6,295,671 | B1 | | 10/2001 | Reesby et al. | |
| 6,351,678 | B1 | | 2/2002 | Borders | |

OTHER PUBLICATIONS

US 2001/0000363 A1, Apr. 26, 2001.
US 2002/0000008 A1, Jan. 3, 2002.

* cited by examiner

*Primary Examiner*—Heather Shackelford
*Assistant Examiner*—Frederick L Lagman
(74) *Attorney, Agent, or Firm*—Ryan Kromholz & Manion, S.C.

(57) ABSTRACT

A medical examination table is adapted to receive at least one two-way drawer assembly with a removable locking mechanism and an articulating backrest. The backrest is controlled by a linear actuator and can be adjusted to any desired position. The backrest requires a relatively small amount of space in the table, and therefore, storage capacity of the table is maximized.

9 Claims, 6 Drawing Sheets

MEDICAL EXAMINATION TABLE WITH TWO-WAY DRAWERS AND ARTICULATING BACKREST

FIELD OF THE INVENTION

The present invention relates to a medical examination table. More particularly, the present invention is directed to a medical examination table having a two-way drawer and an articulating backrest.

BACKGROUND OF THE INVENTION

The use of two-way drawers in medical examination tables is known. Further, many conventional medical examination tables have articulating backrests. However, the prior art does not have many viable options for medical examination tables that have both two-way drawers and a practical articulating backrest.

A general shortfall of the prior art, as will be pointed out below, is that the articulating means of the prior art is cumbersome and therefore impedes efficient utilization of the cabinet for storage purposes.

First, generally, drawers are desirable on medical examination tables because they provide much needed storage space, and can be used to conceal items of interest.

Articulating backrests are also desirable because such backrests provide a range of positions that a patient can be comfortably situated, so that the care giver can most efficiently examine the patient.

By means of example, representative references of the prior art are discussed. One such prior art reference is Fitzgerald (U.S. Pat. No. 2,652,887) Fitzgerald describes a drawer for reading chairs. The drawer can be drawn from beneath either side of the seat. It uses simple guide rails that engages two flanges on the drawer. A handle on two opposing exterior sides of the drawer facilitates manipulation of the drawer.

Poetsch (U.S. Pat. No. 2,72,819) describes a hospital bedside table that includes a two-way drawer located in the upper part of an ancillary cabinet. The two-way drawer contains a channel in an upper edge of a side wall. A sliding stop lug is placed inside the channel and protrudes above the upper surface or edge of the drawer. The stop lug is adapted to slide to either end of the channel and catches an end flange of the cabinet. Thus facilitating full extension of the drawer in each direction, but also preventing accidental removal of the drawer.

Russ (U.S. Pat. No. 1,684,889) describes a double acting drawer and slide. The drawer in Russ is designed to move freely in either direction, that is, opening on opposing sides of a cabinet. The drawer is also self latching, engaging when in a closed position and when in the extended positions. Further, the drawer is supported throughout the range of motion by means of two slide structures, on opposite sides that are parallel to the direction of travel of the drawer. Each slide is composed of two members that move relative to each other. The members are a sliding support and an extension slide. The slides act as friction members, preventing the support slide from moving in advance of the extension slide. The drawer is carried by the extension slide, which engages the drawer by means of slots integrated into the non-adjacent sides parallel to the movement of the drawer. Thus, the drawer is carried by the support slide, the support slide glides on the extension slide, and the extension slide is slidably mounted to a support structure in the cabinet.

Russ also describes an apparatus for preventing hyperextension of the drawer in the open position. This same apparatus assures the adequate support of the drawer throughout its range of motion.

Denquer (U.S. Pat. No. 1,039,708) makes passing reference to single-sided opening drawers on a medical examination table.

Sherer (U.S. Pat. Des. No. 21,646) describes a bed frame with a built-in wardrobe. Sherer describes the use of two abutting drawers in a single, linear enclosure. Both drawers may be removed from opposing sides of the wardrobe in a serial fashion, that is one after the other. This simple design has one drawer pushing or pulling the second drawer in order to extract the drawers from the wardrobe.

Douglass (U.S. Pat. No. 3,334,951) describes a medical examination table having single side opening, but reversibly mountable drawers. The drawers mount on guides and may be opened from only one side of the cabinet. If desired, however, the drawers may be temporarily removed from the cabinet. The guides can then be accessed and reversed, with some effort. Thereafter, the drawers can be re-installed to open from the opposing side of the cabinet. The extent of effort to switch the drawer opening from one side of the cabinet to the opposing side should be noted. The invention in Douglass requires removal of several side panels from their respective channels and frame. Then the drawers are removed. Next, the track support plates must be unbolted from the flanges. Finally, by completing the aforementioned steps in reverse order, the drawers can be replaced to open from the opposing side.

Lentz (U.S. Pat. Des. No. 542,060) describes a surgeon's operating table having double-ended drawers that can be opened from either side of the structure.

Articulating backrests are also discussed in the prior art. For example, Denquer (U.S. Pat. No. 1,039,708) describes a physician's table in which are arranged a set of single side-opening drawers and an adjustable back-rest. The backrest is hinged to a frame of the physician's table and is manipulated to a predetermined range of positions by means of a manual operated crank-handle which causes pinions and gear assemblies interfacing with a toothed rack carried by the back-rest.

Katzfey I (U.S. Pat. No. 3,348,893) describes a power actuated physician's examining table. The table has a cabinet that carries a hinged top. The cabinet provides for a plurality of single side-opening storage drawers. The hinged top is power actuated to provide a predetermined range of positions. The power actuated hinged top uses a link mechanism connected to a hydraulic cylinder.

Katzfey II (U.S. Pat. No. 3,499,529) describes an articulating top for a physician's examination table.

A particular disadvantage of the prior art is the inability of the prior art to combine a two-way drawer, that is a drawer that is accessibly from either side of the examination table without making semi-permanent changes to the table, with an articulating backrest.

Another disadvantage of the prior art is the use of pneumatic or hydraulic, electric, mechanical or their combinations, is the cumbersome nature of such devices and the relatively large amount of room within the examination table they occupy.

Yet another disadvantage of the prior art is the use of single-way drawers. The use of such drawers may necessitate the care giver to compromise the level of care, because the items of interest contained in such drawers is only accessible from one side of the examination table.

Yet another disadvantage of the prior art is the cumbersome, wasteful and inefficient use of materials.

Accordingly, there is a need for a medical examination table that has at least one two-way drawer combined with an articulating backrest. Further, there is a need for a compact mechanism that does not interfere with the location, placement and operation of the drawers or other storage areas of the medical examination table.

Another need is for a backrest that articulates to a variety of positions and can be locked into a specified position. Yet another need is for an articulating backrest that is safe, quiet and smooth in operation.

SUMMARY OF THE INVENTION

A medical examination table having an articulating backrest and at least one two-way drawer solves the shortcomings noted in the prior art.

The cabinet is a conventional medical examination table, as well known and described in the prior art. However, the present invention incorporates several two-way drawers and an articulating backrest in a way not available in the prior art.

Each two-way drawer offers the user with access to the drawer from either side of the medical examination table. The drawer is equipped with a latching mechanism that prevents the drawer from falling out of an opening provided by the medical examination table. The latching mechanism also has predetermined detents that pause the drawer at selected positions throughout a range of travel of the drawer. Further, one detent position, for example, is the closed position whereby the latching mechanism maintains the drawer in such a position until the mechanism is engaged.

A removable stop is provided to selectively prevent the drawer from being removed from one side. This is particularly important when the medical examination table is situated against a wall and it is undesirable for the drawer face adjacent to wall to contact the wall.

A removable stop is provided to selectively prevent the drawer from being opened from one side of the medical examination table.

Each drawer also has at least one handle to facilitate manipulation of the drawer.

The drawer can be fabricated, for example, from any number of conventional materials and colored, for example, to any desired scheme.

The drawer slides transversely in the opening of the table by any number of conventional means, such as, rolling elements on a guided telescoping track. However, said conventional means being adapted to facilitate the two-way opening drawer of the present invention.

Of particular interest is the table's articulating backrest. The backrest is hinged to the table at, for example, a conventional seat. Such seats are well described in the prior art. However, the articulating backrest can be positioned in a range of inclinations from horizontal to vertical (relative to the seat) by use of a linear actuator.

One of the advantages of the present invention is that the linear actuator requires much less space than the articulating means used in the prior art. This reduction in space allows, for example, the use of two-way drawers. Another benefit is, for example, an increase in the available storage area under the backrest.

The incorporation of a linear actuator to a backrest so to provide a range of inclination angles offers additional advantages over the prior art. For example, the linear actuator offers a relatively wide range of inclination angles from near horizontal to about a vertical position. Moreover, the increments, or spacing between selectable angles of inclination are very small, thus offering a nearly infinite range of positions between the nearly horizontal position to about the vertical position. This flexibility in the range of inclination angles permits a care giver to situate the patient precisely as needed. Further, the linear actuator of the present invention provides a smooth transition between positions. The present invention is easy to operate, quiet and stable.

The linear actuator incorporates a pressure release valve. This valve allows precise adjustments to the amount of incline the backrest is subjected. The valve may be manipulated, for example, by actuating a conveniently located lever. The lever, for example, is rigidly carried by a rod, the rod being rotably mounted to the backrest so to present an actuation tab to engage with the pressure release valve. In this manner, for example, the caregiver can engage and disengage the pressure release valve of the linear actuator, thereby adjusting the inclination angle of the backrest. When the pressure release valve is disengaged, the backrest is prevented from traveling toward the horizontal position. This is an important feature because it prevents the backrest collapsing during use by a patient.

One end, the proximal end, of the linear actuator is pivotally fixed to the table. The other end, the distal end of the linear actuator is rotably mounted to the backrest by means of a yoke and clevis seat. The yoke and clevis, in addition to supporting the backrest, carry a rod. The rod has an actuator tab rigidly attached to it, and at each end of the rod, there are levers. The levers extend beyond the table, one on each side. This arrangement allows the care giver to turn each lever, and thereby engaging or disengaging the pressure release valve on the linear actuator, which, in turn permits or resists alterations in the inclination level of the backrest.

Because the linear actuator used on the articulating backrest of the present invention is a compact design, the present invention also includes a plurality of two-way drawers, as previously discussed.

Figure 1:
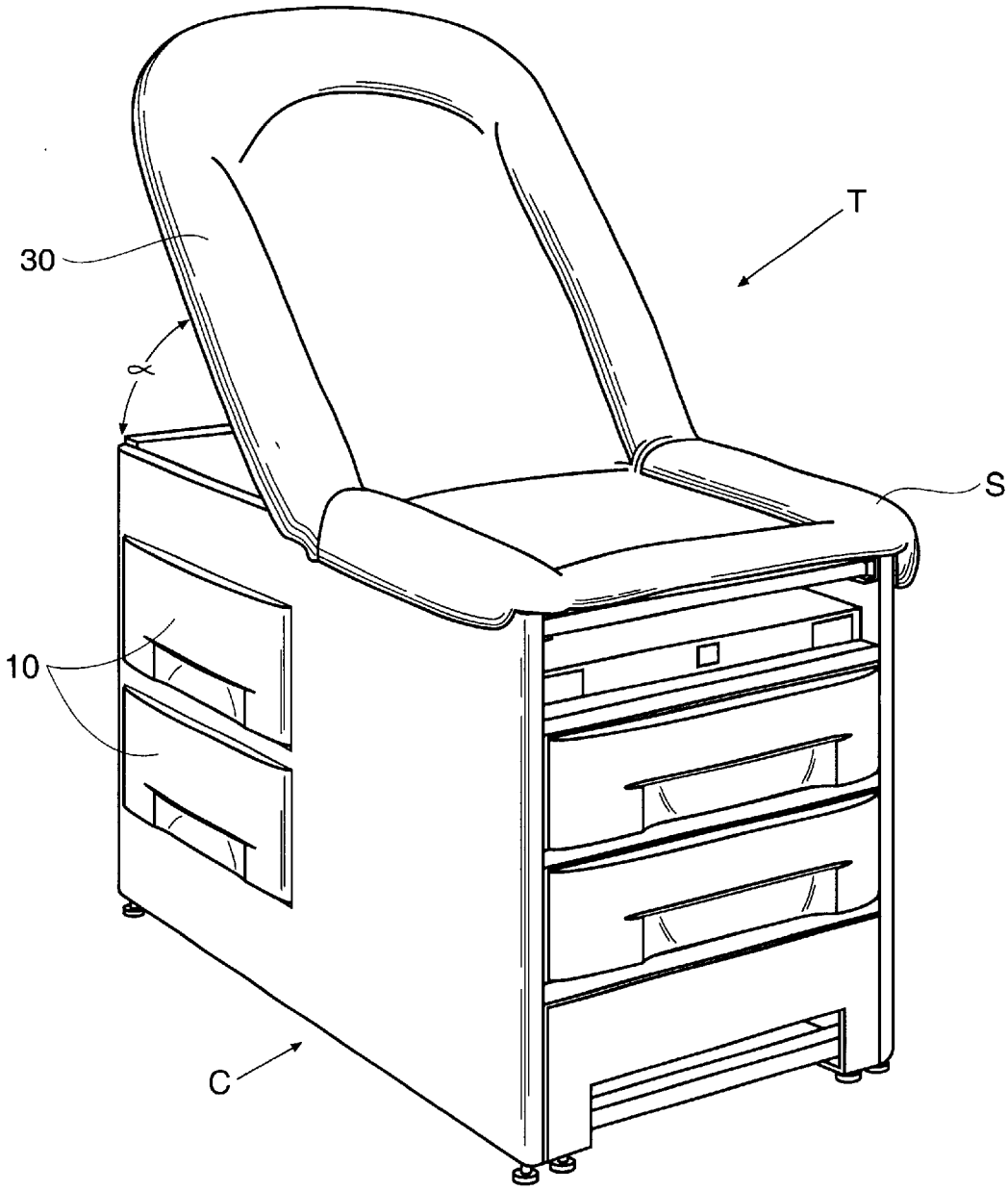
FIG. 1 is a perspective front and side view of an embodiment of the present invention with the backrest in an inclined position, while the drawers are shown in the closed position.

The invention may be embodied in several forms without departing from its spirit or essential characteristics. The scope of the invention is defined in the appended claims, rather than in the specific description preceding them. All embodiments that fall within the meaning and range of equivalency of the claims are therefore intended to be embraced by the claims.

DETAILED DESCRIPTION

Although the disclosure hereof is detailed and exact to enable those skilled in the art to practice the invention, the physical embodiments herein disclosed merely exemplify the invention which may be embodied in other specific structure. While the preferred embodiment has been described, the details may be changed without departing from the invention, which is defined by the claims.

The preferred embodiment of the present invention is a medical examination table with an articulating backrest and at least one two-way drawer located in a cabinet of the table.

The drawers of the present invention are two-sided, that is they can be opened from either side of the cabinet. The drawers slide on conventional drawer slide mechanisms. In our preferred embodiment, the mechanisms are mounted on the underside of each drawer bottom. Unlike the some of the prior art inventions, there is no cumbersome re-assembly of components in order to provide the two-sided opening of the present invention. One simply grasps a handle and pulls or pushes the drawer in the desired direction. The drawer can then be immediately manipulated in the opposite direction. In this manner the contents of the drawer, for example, may be accessed from one side of the cabinet, and then immediately be accessed from the opposite side of the cabinet.

A removable latching mechanism 18 mounted in a cabinet enclosure drawer opening prevents the drawer from being opened on one side of the examination table. A second latching mechanism prevents the drawer from extending beyond the designed range of motion, thus preventing the drawer from accidentally, for example, being removed from the cabinet enclosure.

In the preferred embodiment, the articulating backrest is hingeably connected to a seat of the table. This configuration allows independent operation of either the seat or the backrest. The backrest, while concealing a storage area, also locks in to any desired position from the generally horizontal position to a generally vertical position. The locking mechanism of the current invention comprises a linear actuator having a pressure release valve. As the backrest is inclined from the generally horizontal position, the locking mechanism prevents the backrest from returning to a lesser inclination angle. Thus, the care giver can select a desired inclination angle and position the backrest accordingly, without the backrest returning to a lesser inclination angle. To reduce the angle of inclination, the care giver may actuate a lever located on either side of the examination table. The lever is connected to a rod that carries an actuation tab. The actuation tab engages a pressure release valve located on a linear actuator. The linear actuator in the preferred embodiment is, for example, a pneumatic cylinder. While one end of the cylinder is connected to the backrest, the opposite end is pivotally mounted to the table.

Referring now to the drawing, specifically to FIG. 1 an embodiment of the present invention is demonstrated. From this view of the medical examination table T, two drawers 10 are shown in the cabinet C. On top of the cabinet C there is a seat S and a backrest 30. A backrest is shown at an inclined angle $\alpha$.

Figure 2:
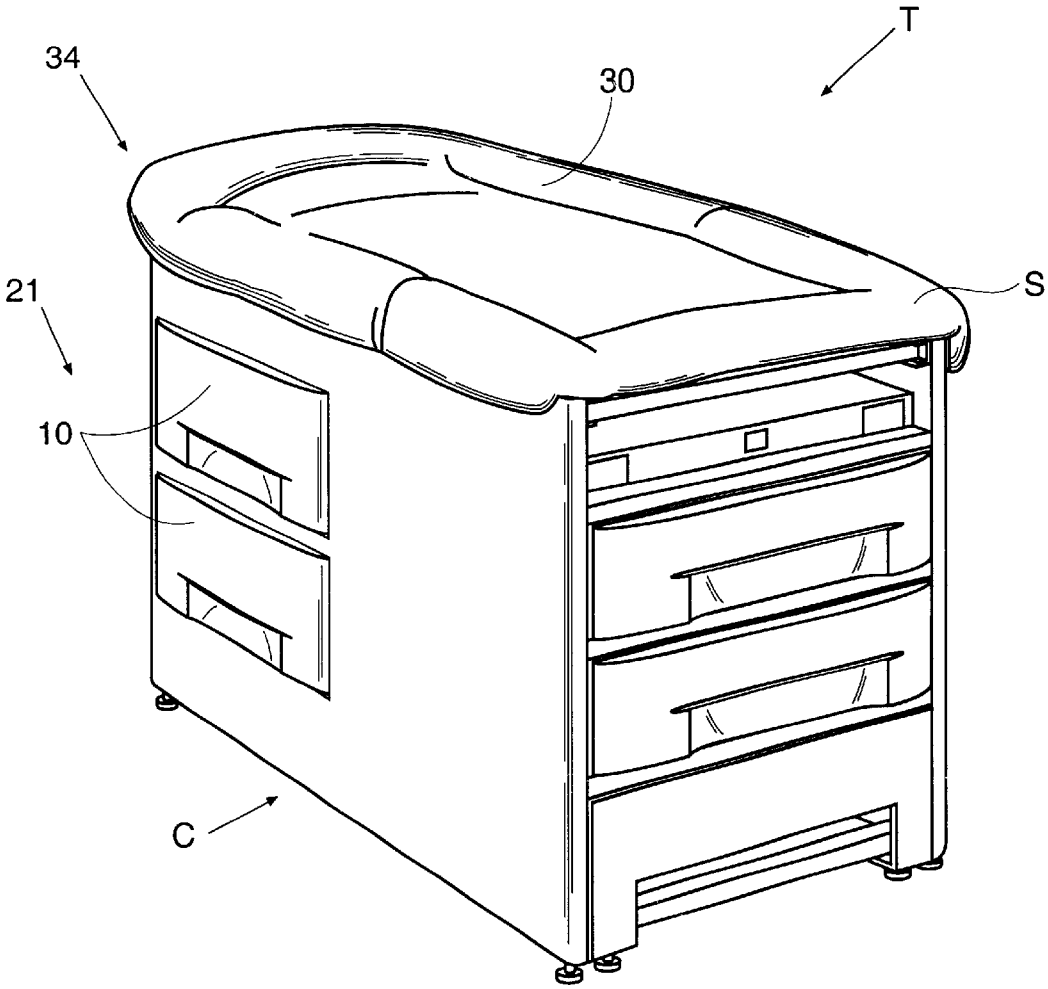
FIG. 2 is a perspective front and side view of an embodiment of the present invention with the backrest in a generally horizontal position, while the drawers are shown in the closed position.

Now referring to FIG. 2 the table T is generally shown with the backrest 30 in a generally horizontal position 34. The relationship of the backrest 30 to the seat S can be seen. Again, the drawers 10 are shown positioned within the cabinet C, in the closed position 21.

Figure 3:
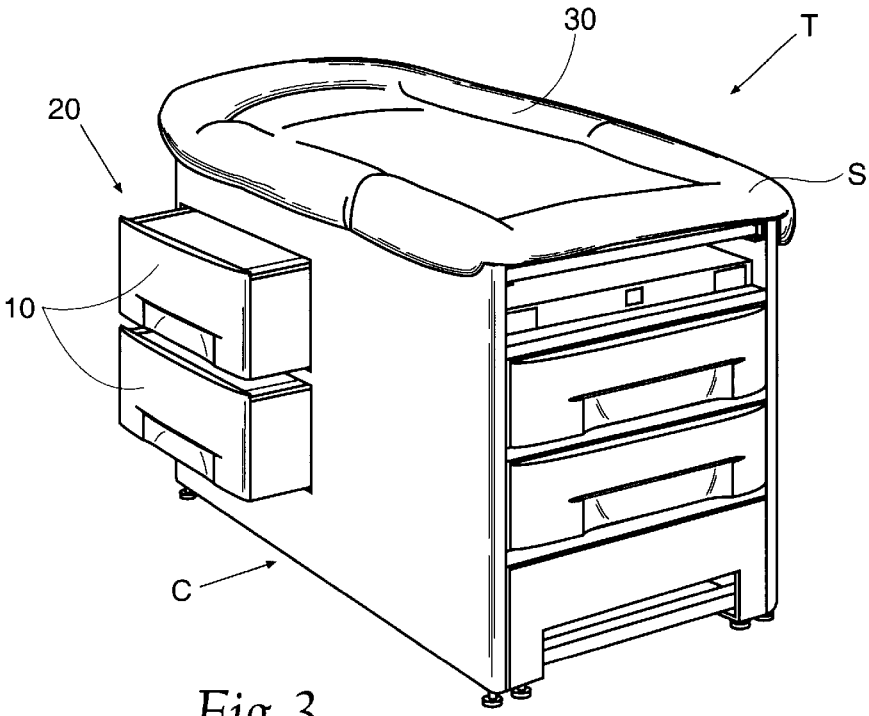
FIG. 3 is a perspective front and side view of an embodiment of the present invention with the backrest in a generally horizontal position, while the drawers are shown in a partial open position, the drawers opening to the left of the table.
Figure 4:
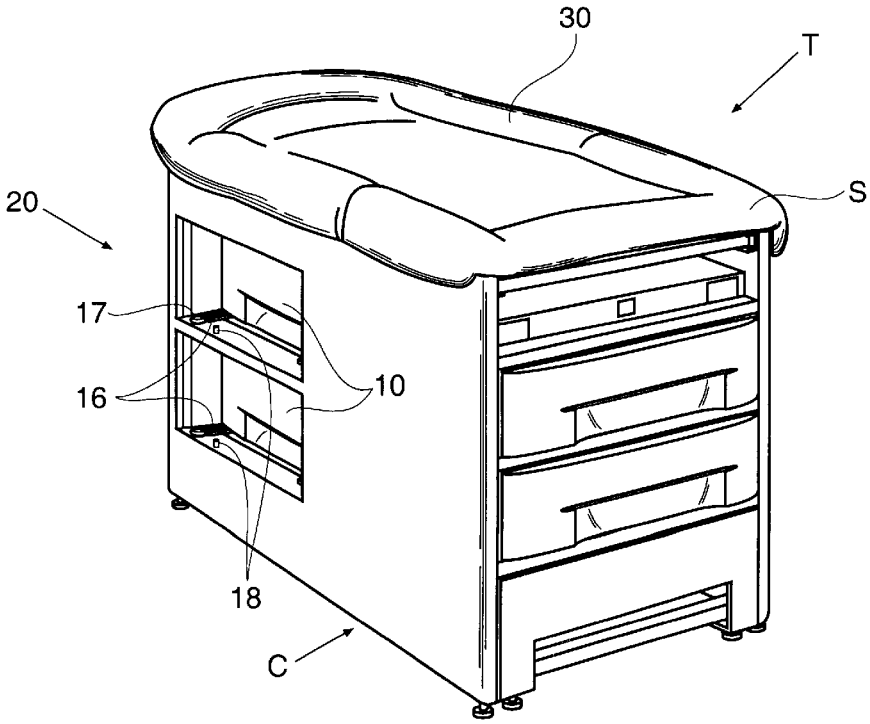
FIG. 4 is a perspective front and side view of an embodiment of the present invention with the backrest in a generally horizontal position, while the drawers are shown in a partial open position, the drawers opening to the right of the table.

Referring to FIG. 3 and FIG. 4, the drawers 10 are shown in a partially open position 20. In FIG. 3, the drawers 10 are shown open 20 toward the viewer. While in FIG. 4, the drawers 10 are shown in the open position 20 away from the viewer and the lower drawer slide mechanism members 16 mounted on supports 17 are visible.

Figure 5:
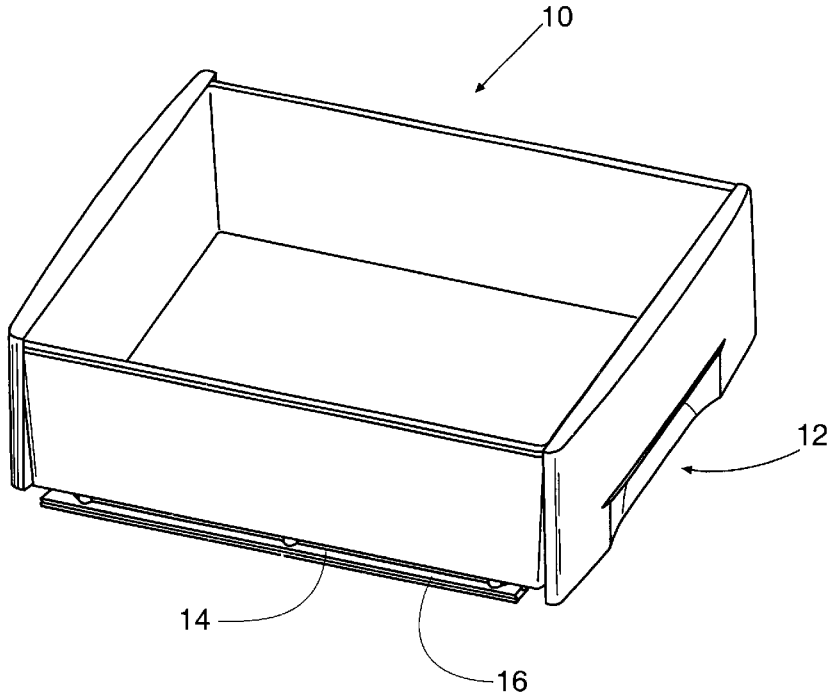
FIG. 5 shows an isometric view of a drawer of the present invention.

Referring now to FIG. 5, th drawer 10 is shown removed from the cabinet (not shown). Each drawer 10 has two front faces, each face including a handle 12 formed therein. While our preferred embodiment shows the handle as being integrally formed with the drawer front, it is to be understood that the handle could comprise a separate element mounted or otherwise connected to the drawer 10. FIG. 5 also depicts the two members 14 nd 16 of slide mechanism 22 in relation to each other.

Figure 5A:
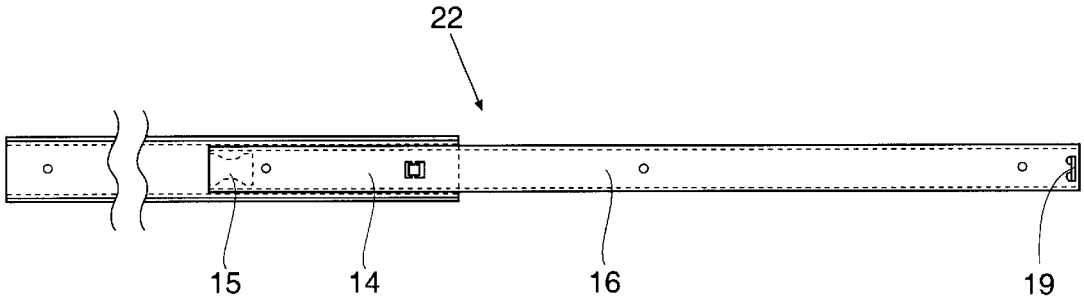
FIG. 5*a* shows a top plan view of the drawer slide mechanism.

The slide mechanism 22 is shown in detail in FIG. 5*a*. Upper slide member 14 is mounted to the underside of a drawer 10. Lower or second slide member 16 is mounted with an opening in the cabinet C. Members 14 and 16 slide in a longitudinal direction parallel to one another. These types of mechanisms are well known in the art. One or more bearings or bearing surfaces (not shown) are provided to facilitate the sliding relationship of members 14 and 16. In our preferred embodiment, the slide mechanism 22 further includes a stop mechanism 19 that prevents the drawer 10 from being accidentally removed from the cabinet C. One or more detents 15 may also be provided so that the operator has a positive indication when the drawer 10 has reached its closed position.

Figure 6:
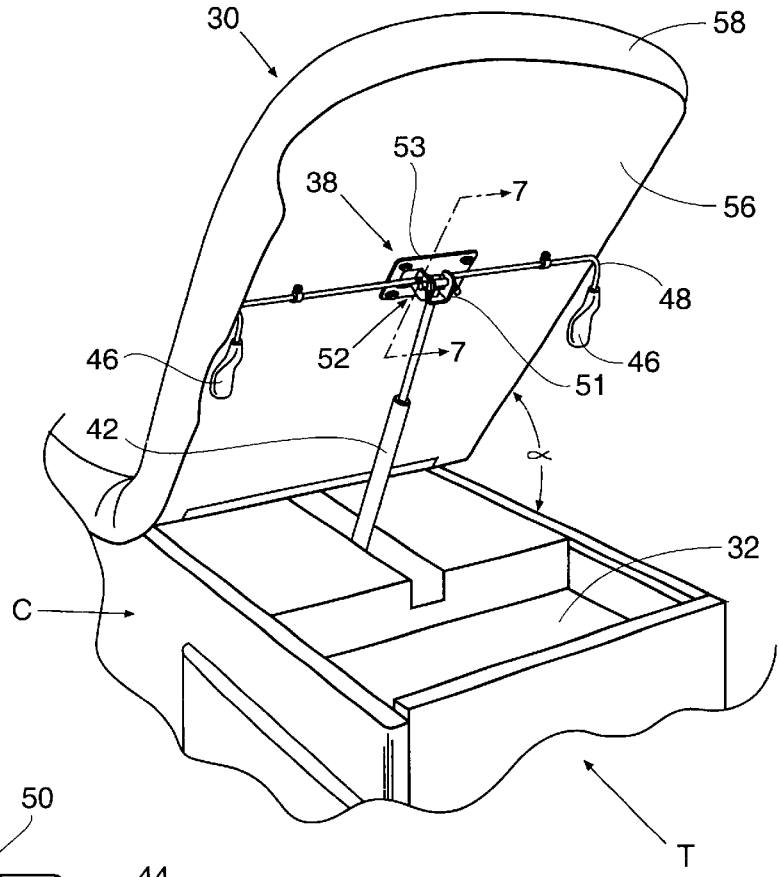
FIG. 6 shows a partial perspective view from the back of the present invention highlighting the backrest and articulator assembly.

Referring to FIG. 6, an embodiment of the present invention is shown in a partial perspective view from the rear of the table T. The backrest 30 is shown at a selected inclination angle $\alpha$, exposing a storage area 32 in the cabinet C. A locking mechanism 38 is generally shown. The locking mechanism 38 comprises the backrest 30, having a support structure 56 and a pad with webbing 58, and a linear actuator 42. The backrest 30 is attached to a linear actuator 42 at a distal end 52. The proximal end (not shown) is pivotally mounted to the table T.

Still referring to FIG. 6, two levers 46 are rigidly attached to a rod 48. The rod 48 is rotatably mounted to the support 56 by means of a yoke 51 and a clevis seat 53. The rod 48 presents an actuation tab (not shown) to engage with a pressure release valve (not shown) at the distal end 52 of the linear actuator 42.

Figure 7:
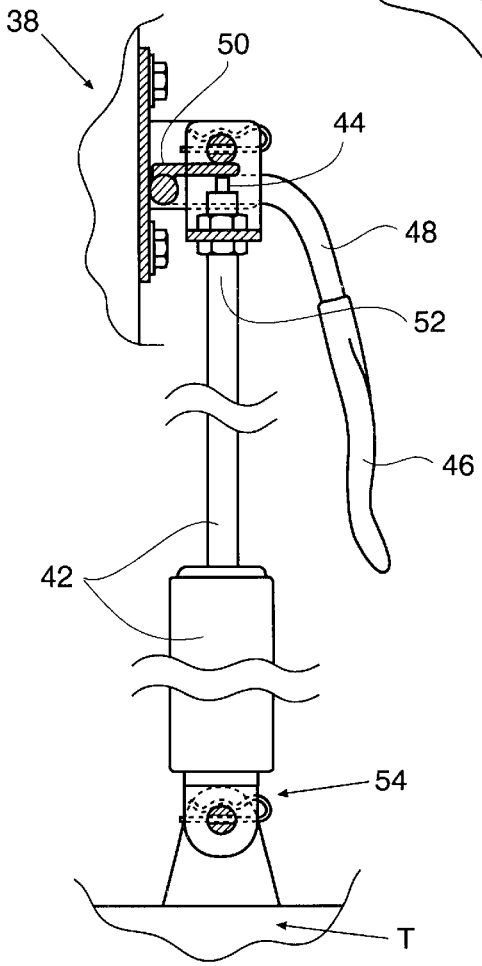
FIG. 7 is a break-away profile view of the articulator assembly.
Figure 8:
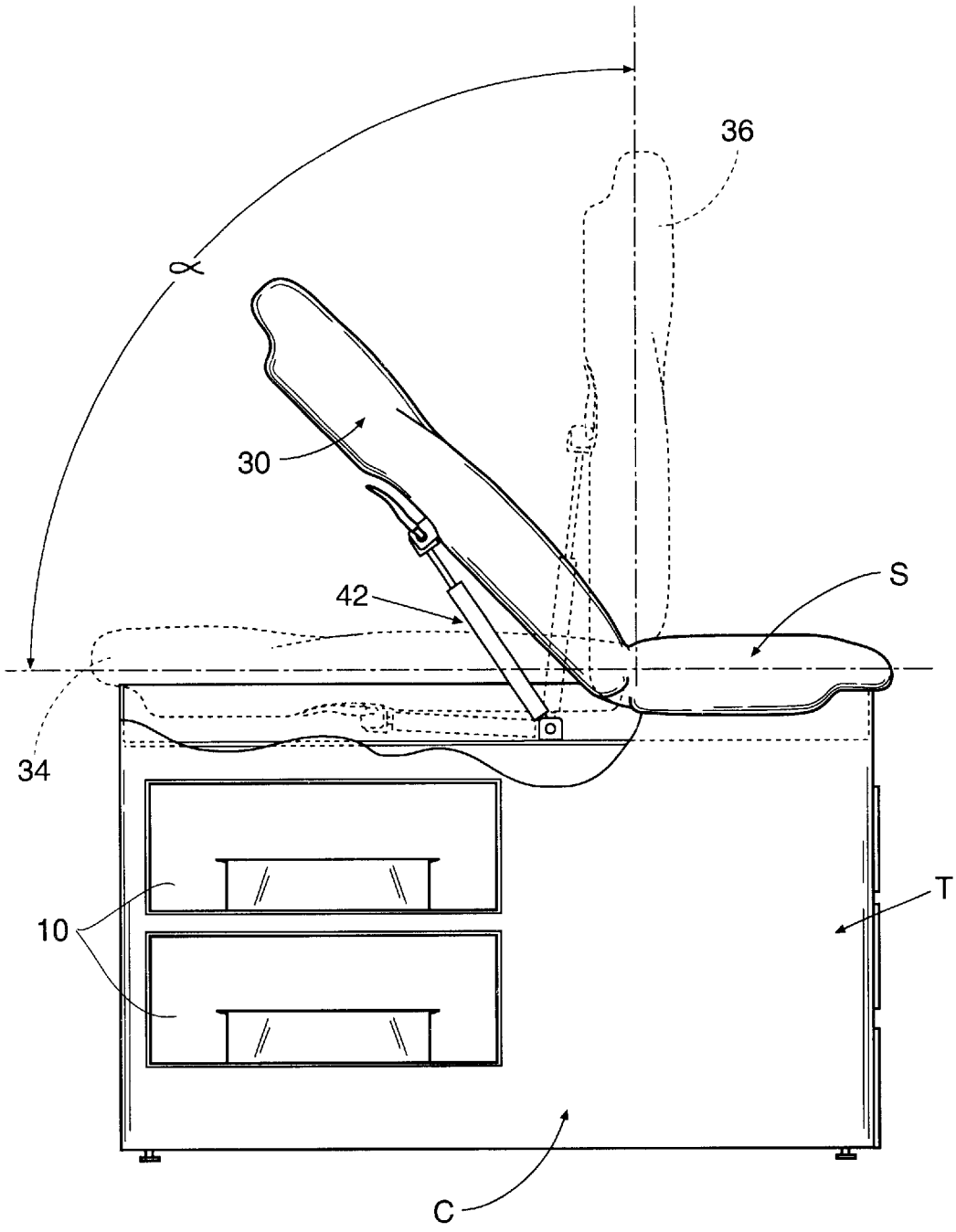
FIG. 8 is a side view with a partial break-away section showing the range of inclination angles of the present invention.

Now referring to FIG. 7, the locking mechanism 38 is shown in greater detail. The relationship of the actuation tab 50, which is rigidly attached to the rod 48, is shown in relation to the pressure release valve 44 on the distal end 52 of the linear actuator 42. The proximal end 54 of the linear actuator 42 is shown pivotally mounted to the table T.

The above-described embodiments of this invention are merely descriptive of its principles and are not to be limited. The scope of this invention instead shall be determined from the scope of the following claims, including their equivalents.

What is claimed is:

1. An articulating backrest for a medical examination table, said table having a seat, the articulating backrest comprising:

a support structure, adjacent to said seat;

a linear actuator, the linear actuator having a proximal end and a distal end, the proximal end being attached to the table and the distal end attached to said support structure; and actuating means to selectively actuate the linear actuator, said actuating means comprising:

a pressure release valve located at the distal end of the linear actuator;

a rod, said rod rotatably mounted to the backrest;

an actuator tab, said tab rigidly mounted to the rod, whereby the actuator tab engages the pressure release valve when selectably engaged with said valve, said valve adapted to receive said actuator tab; and at least one lever, said lever affixed to the rod, whereby selected actuation of the lever causes the actuator tab to engage and disengage the pressure release valve.

2. The articulating backrest of claim 1 wherein the support structure comprises:

a pad;

a webbing;

a rigid support; and a means for attaching the linear actuator to the articulating backrest.

3. The articulating backrest of claim 2 wherein the means for attaching the linear actuator to the articulating backrest comprises:

a clevis seat;

a plurality of fasteners, said fasteners coupling the clevis seat to the rigid support;

a yoke, said yoke coupled to the linear actuator at the distal end, and rotably linked to the clevis seat.

4. A medical examination table comprising:

a two-way drawer mechanism;

an opening for receiving said two-way drawer mechanism and a supporting track within said opening, said two-way drawer mechanism being coupled to said track;

at least one drawer, the two-way drawer mechanism being coupled to said drawer;

an articulating backrest comprising a support structure, a linear actuator, the linear actuator having proximal end and a distal end, the proximal end being attached to the table and the distal end attached to said support structure, and actuating means to selectively actuate the linear actuator, said actuating means comprising:

a pressure release valve located at the distal end of the linear actuator;

a rod, said rod rotatably mounted to the backrest;

an actuator tab, said tab rigidly mounted to the rod, whereby the actuator tab engages the pressure release valve when selectably engaged with said valve, said valve adapted to receive said actuator tab; and at least one lever, said lever affixed to the rod, whereby selected actuation of the lever causes the actuator tab to engage and disengage the pressure release valve.

5. The examination table of claim 4 further including a removable stop, said removable stop being removably connected to said supporting track.

6. An articulating backrest for a medical examination table, said table having a seat, the articulating backrest comprising:

a support structure, adjacent to said seat;

a linear actuator, the linear actuator having a proximal end and a distal end, the proximal end being attached to the table and the distal end attached to said support structure; and actuating means to selectively actuate the linear actuator, said actuating means comprising:

a pressure release valve located at the distal end of the linear actuator; and an actuator tab, said tab rigidly mounted to the rod, whereby the actuator tab engages the pressure release valve when selectably engaged with said valve, said valve adapted to receive said actuator tab.

7. The articulating backrest for a medical examination table of claim 6 further comprising:

at least one lever, said lever affixed to said actuator tab, whereby selected actuation of the lever causes the actuator tab to engage and disengage the pressure release valve.

8. A medical examination table comprising:

a two-way drawer mechanism;

an opening for receiving said two-way drawer mechanism and a supporting track within said opening, said two-way drawer mechanism being coupled to said track;

at least one drawer, the two-way drawer mechanism being coupled to said drawer;

an articulating backrest comprising a support structure, a linear actuator, the linear actuator having proximal end and a distal end, the proximal end being attached to the table and the distal end attached to said support structure, and actuating means to selectively actuate the linear actuator, said actuating means comprising:

a pressure release valve located at the distal end of the linear actuator;

a rod, said rod rotatably mounted to the backrest;

an actuator tab, said tab rigidly mounted to the rod, whereby the actuator tab engages the pressure release valve when selectably engaged with said valve, said valve adapted to receive said actuator tab.

9. The medical examination table of claim 8 further comprising:

at least one lever, said lever affixed to the rod, whereby selected actuation of the lever causes the actuator tab to engage and disengage the pressure release valve.

* * * * *